United States Patent [19]

Wilson

[11] 4,433,563

[45] Feb. 28, 1984

[54] LOCK DECODER

[76] Inventor: Glenn E. Wilson, 24 Spring St., Endicott, N.Y. 13760

[21] Appl. No.: 366,355

[22] Filed: Apr. 7, 1982

[51] Int. Cl.[3] ..... E05B 17/00

[52] U.S. Cl. ..... 70/446; 70/442; 364/130

[58] Field of Search ..... 70/442, 446; 364/130, 364/174, 400

[56] References Cited

U.S. PATENT DOCUMENTS 2,974,517 5/1961 Jacobs ..... 70/442

4,056,956 11/1977 Gillian ..... 70/446

4,126,821 11/1978 Cannon ..... 364/400

4,377,847 3/1983 Daniel ..... 364/130

*Primary Examiner*—Sal Cangialosi

*Attorney, Agent, or Firm*—Bruns & Jenney

[57] ABSTRACT

Apparatus for determining the opening combination of a safe lock including a dial turning device that is controlled by a programmable processor acting through a stepping motor to set selected combinations into the lock and to test the lock after each combination has been set to determine if the lock bolt has been withdrawn to a release position. A readout of each combination set into the lock is provided and the readout is automatically inhibited to identify the opening combination when the lock bolt has been withdrawn to a release position.

13 Claims, 6 Drawing Figures

LOCK DECODER

BACKGROUND OF THE INVENTION

This invention relates to apparatus for determining the opening combination of a safe lock and, in particular, to a programmable device capable of automatically dialing an ordered sequence of combinations into the lock and testing the lock after each combination has been set in to determine if the combination will open the lock.

Where the combination of a safe or vault has been forgotten, lost or otherwise unobtainable, it is generally left to the skill of the individual locksmith who is employed to open the safe to determine exactly what digits are embodied in the opening combination. Even under ideal conditions, where the workings of the lock are familiar and one or more numbers in the combination are known, the task of opening the safe can be extremely time consuming and costly. In some procedures, particularly where the workings of the lock mechanism are old and not understood, holes are sometimes drilled into the lock assembly to allow the locksmith to actually see and/or manipulate the tumblers and release mechanism embodied therein. These drilling procedures while effective in opening the safe or vault usually make it necessary to replace the lock. In any event, regardless of the procedures involved, finding the opening combination of a safe or vault has typically proven to be an extremely difficult and sometimes frustrating task.

SUMMARY OF THE INVENTION

It is therefore an object of the present invention to improve techniques for finding the opening lock combination of a safe or a vault.

A further object of the present invention is to reduce the amount of time that is needed to find the opening combination of a safe or vault where the combination is unavailable.

A still further object of the present invention is to provide a device that will automatically find the opening combination of a safe or vault.

Yet another object of the present invention is to automatically find the opening combination of a safe without damaging the lock or the safe.

Another object of the present invention is to reduce the costs involved in opening a safe or vault where the combination to the lock is unobtainable.

A still further object of the present invention is to provide a programmable device for automatically finding the combination to a lock that does not require a skilled locksmith to operate.

These and other objects of the present invention are attained by programmable apparatus for turning the dial of a combination lock through a stepping motor to an ordered sequence of possible combinations and testing the lock after each combination has been set into the lock to determine if the lock bolt has been withdrawn to a release position. A readout of the combination set into the lock is provided and the readout is automatically inhibited when the bolt is released thus identifying the opening combination.

BRIEF DESCRIPTION OF THE DRAWINGS

For a better understanding of these and other objects of the present invention reference is had to the following detailed description of the invention which is to be read in conjunction with the accompanying drawings wherein.

DESCRIPTION OF THE INVENTION

Figure 1:
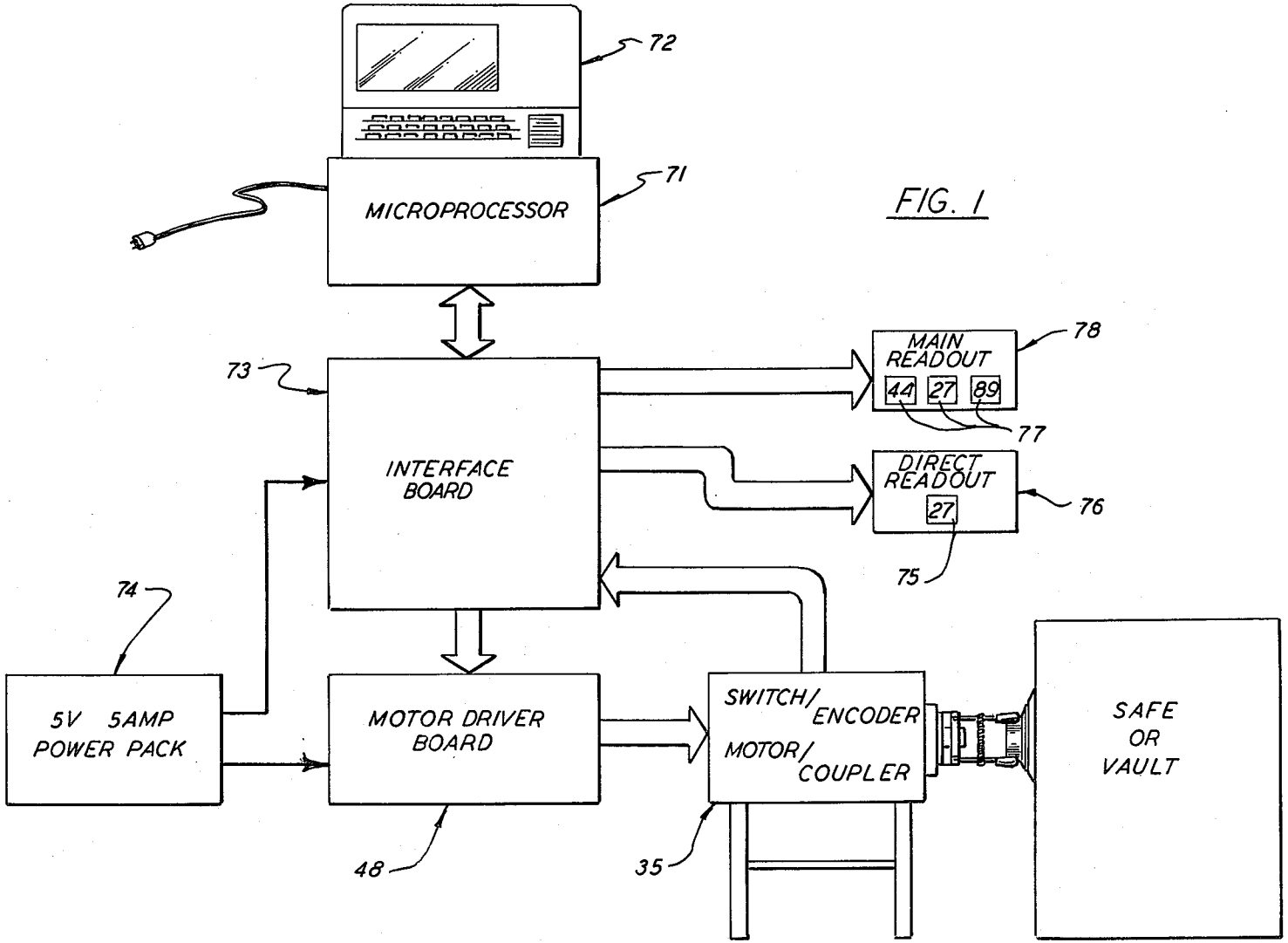
FIG. 1 is a block diagram depicting the component parts of the present invention and further indicating the flow of information between the various units.

The apparatus of the present invention will be described with specific reference to a typical three tumbler combination lock of the type illustrated in FIGS. 2 and 3. A brief explanation of the workings of the lock are deemed important for an understanding of the present invention. The lock, which is generally referenced 10, is shown in a fully opened condition in FIG. 2 wherein the opening combination has been set therein by the dial 11 and the bolt 12 has been drawn back into the lock housing 13 to thereby release the lock hasp (not shown). It should be understood that the lock assembly is embedded in the door 14 (FIG. 4) of a safe or vault and prevents the door from being opened until such time as the bolt is withdrawn. The dial 11 is mounted upon a shaft 15 that passes into the housing and which is securely affixed to a cylindrical element 16 that is herein referred to as a "driver". The dial, and thus the driver, are free to be rotated in either a clockwise or counterclockwise direction about the axis of the shaft. Typically, the dial face is provided with one hundred equally spaced integers or numbers ranging from 0 to 99 that are indexed against a reference mark or crow's-foot inscribed on the door adjacent to the dial so as to set a desired number into the lock.

The present lock contains three cylindrical tumblers 18–20 that are mounted for independent rotation about the axis of the lock shaft by means of an annular bushing 22. Movement of the tumblers is controlled through the driver. The driver is connected to the last tumbler 18 in the series by means of a pair of coacting cogs 23 and 24. Cog 23 is secured in the back face of the driver while cog 24 is similarly secured in the adjacent front face of tumbler 18. The cogs are situated the same distance from the axis of the dial shaft and are further arranged to overlap axially. As the driver is rotated in either direction, cog 23 will eventually pick up cog 24 and cause the tumbler 18 to turn with the driver.

Identical sets of interferring cogs are secured in the adjacent end faces of the three tumblers so that as the driver continues to be turned in a given direction, the tumblers will be sequentially coupled to the driver through each of the coacting cog sets. Accordingly, the middle tumbler 19 in the series will be picked up by the driver during the second full revolution of the dial while the last tumbler 20 is picked up during the third full revolution of the dial. To dial a three number combination into the lock, the dial must therefore be turned four turns in one direction to the first number, three turns in the opposite direction to the second number, two turns back to the last number. As will be explained in greater detail below, once the combination has been set into the lock, the dial is then moved through an opening sequence that permits the driver to withdraw the lock bolt.

Figure 2:
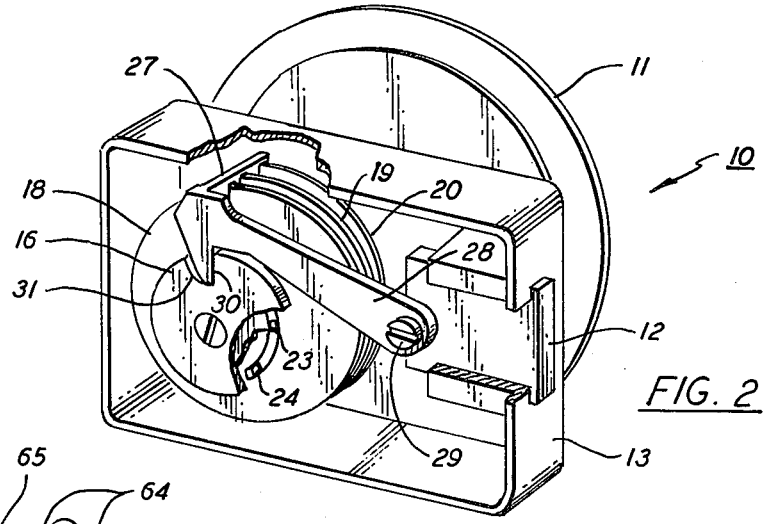
FIGS. 2 and 3 are perspective views of a typical three tumbler combination lock used in a wide variety of safes and vaults with portions broken away to more clearly show the relationship between coacting parts.
Figure 3:
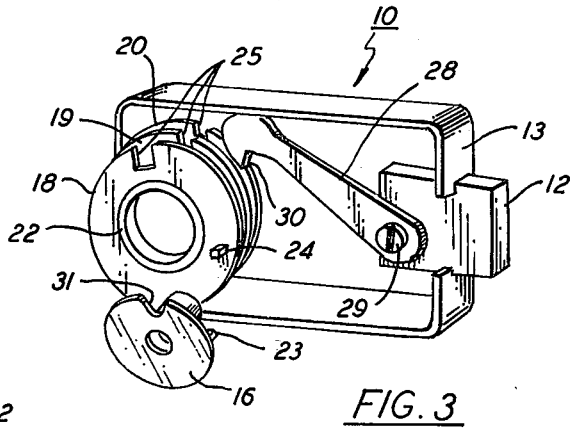

As seen in FIGS. 2 and 3, each tumbler has a square shaped notch 25 cut radially into the periphery thereof. The notches are arranged so that when the opening combination is set into the lock, the three notches are brought into axial alignment immediately beneath a rectangular dog 27 so that the dog is able to drop into the notches. In assembly, the dog is secured by any suitable means to a link 28. The proximal end of the link is connected to the bolt 12 by means of a pivot pin 29 while the distal end of the link is provided with a downwardly turned key 30 that is receivable within a complimentary contoured slot 31 cut into the driver. Two distinct happenings must therefore occur before the driver can be connected to the link. First the tumbler notches must be aligned beneath the dog and secondly the key must be inserted into the driver. Once the opening combination is set into the lock, the dial must be turned back in a clockwise direction to about a zero dial setting to permit insertion of the key. To complete the opening sequence, the dial must be further turned a sufficient distance to allow the driver to retract the bolt. It is important to note that once the bolt is fully withdrawn further rotation of the dial in a clockwise direction will be prevented by the link mechanism. Turning the driver in the opposite direction forces the bolt back into a locking position and also raises the link sufficiently to release both the key and the dog from engagement with the driver and tumblers thereby resecuring the lock until such time as the opening combination is reset and the opening sequence carried out.

Figure 4:
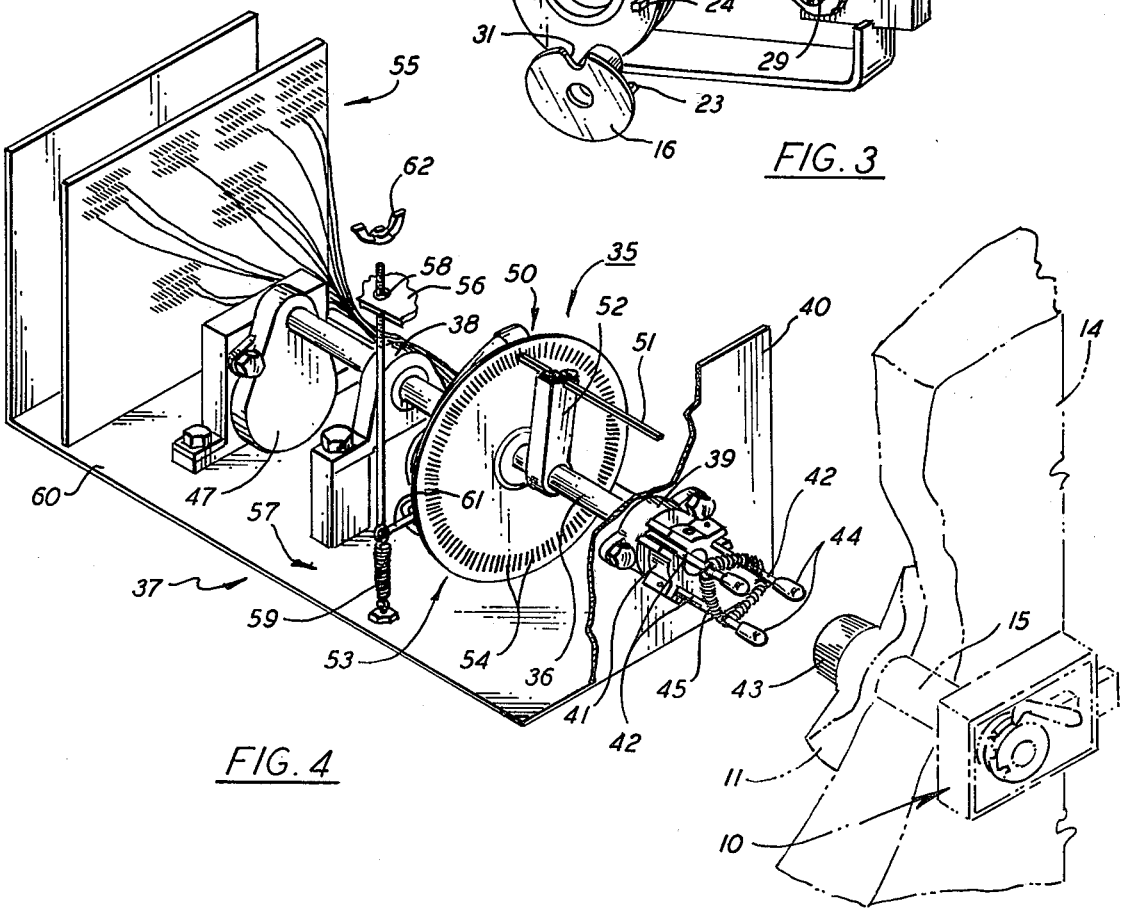
FIG. 4 is an exploded view in perspective showing the switch/encoder and motor/coupler assembly utilized in the apparatus of the present invention.

Turning now more specifically to FIG. 4, there is shown a motor/coupler and switch/encoder unit 35 of the present invention which is designed to automatically control the operation of the dial of the lock 10 so that the dial can be sequentially passed through a series of preselected combinations and opening sequences to determine which combination will open the lock.

Unit 35 includes a centrally located shaft 36 that is supported within a housing 37 by means of a pair of bearing blocks 38 and 39. The shaft protrudes outwardly from the front face 40 of the housing and has a spider 41 secured by any suitable means to the extended outwardly end thereof. Three equally spaced arms 42—42 are pivotably mounted in the spider and extend outwardly so that they can encircle the rotor 43 of the dial. Each arm has a rubber-like cap 44 mounted thereon to enable the arms to firmly grip the rotor in a non-slip manner. A spring 45 surrounds the arms and functions to bias the arms inwardly with sufficient force to permit the dial to turn in response to the shaft 36.

Rotation of the shaft is achieved through means of a stepping motor 47 which is coupled directly to the shaft in assembly. The motor is capable of being stepped incrementally in either a clockwise or a counterclockwise direction in response to a coded input from the motor driver board 48 (FIG. 1). The motor is further arranged to be stepped through 100 increments for each full revolution of the shaft. Each increment represents one integer or number on the dial face. A single pole, one hundred throw switch 50 provides continuous data concerning the exact position of the dial. The switch includes a wiper arm 51 that is secured to the shaft by a bracket 52 for rotation therewith. The arm acts in association with a circular contact board 53 containing one hundred equally spaced contacts 54—54. As the wiper arm is turned by the shaft, the contacts are opened and closed in sequence. Each contact represents a number on the dial ranging in series from 0 through 99. The contacts are wired directly to an encoder board 55 that provides a digital output signal that is indicative of the contact number when the contact is closed by the wiper arm. In assembly, the contacts are aligned with the wiper arm so that the output signal is always indicative of the exact number indexed under the dial indicator. Accordingly, the encoder continually tracks the dial and sends out accurate information concerning the exact dial setting which is in a digital form that is fully compatible with most general purpose computers.

Positioning of the contact board is adjusted by means of a calibration mechanism 57 that includes an elongated rod 58 which passes through the top of the housing 56 and a spring 59 that secures the rod to the floor 60 of the housing. A lever arm 61 is securely affixed at one end to the rod and at the other end to the board so that raising or lowering of the rod against the biasing pressure of the spring will cause the board to rotate. The upper end of the rod is threaded to receive a thumb screw 62. In operation, the screw acts against the top of the housing 56 to position the rod and thus adjust the angular position of the contact board. Through use of the calibration mechanism the switch contacts can be quickly aligned with the corresponding numbers on the dial to provide an accurate readout of the exact number set beneath the dial index.

Figure 6:
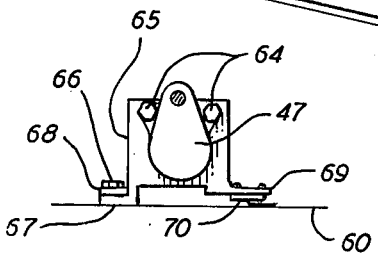
FIG. 6 is an end view of the inhibiting mechanism used in the present invention.

Turning now to FIG. 6, the stepping motor is secured as by bolts 64—64 to a flexible mount 65. The mount is attached to the floor of the housing by a bolt 66 passing downwardly through flange 67 and a resilient mounting pad 68 formed of a resilient rubber-like material. The opposed flange 69 of the mount rests upon a pressure sensitive switch 70. Under normal operating conditions wherein the motor is freely turning the safe dial to set different combinations therein, the switch will remain in a normally open condition. However, in the event the opening combination is reached and the bolt opening sequence has been completed, the shaft will be restricted from further movement by the bolt linkage thereby placing a high torque on the motor. This, in turn, causes the mount to deflect sufficiently against the deformable pad to close the pressure sensitive switch and thus generate an output signal, the function of which will be explained in further detail below.

Figure 5:
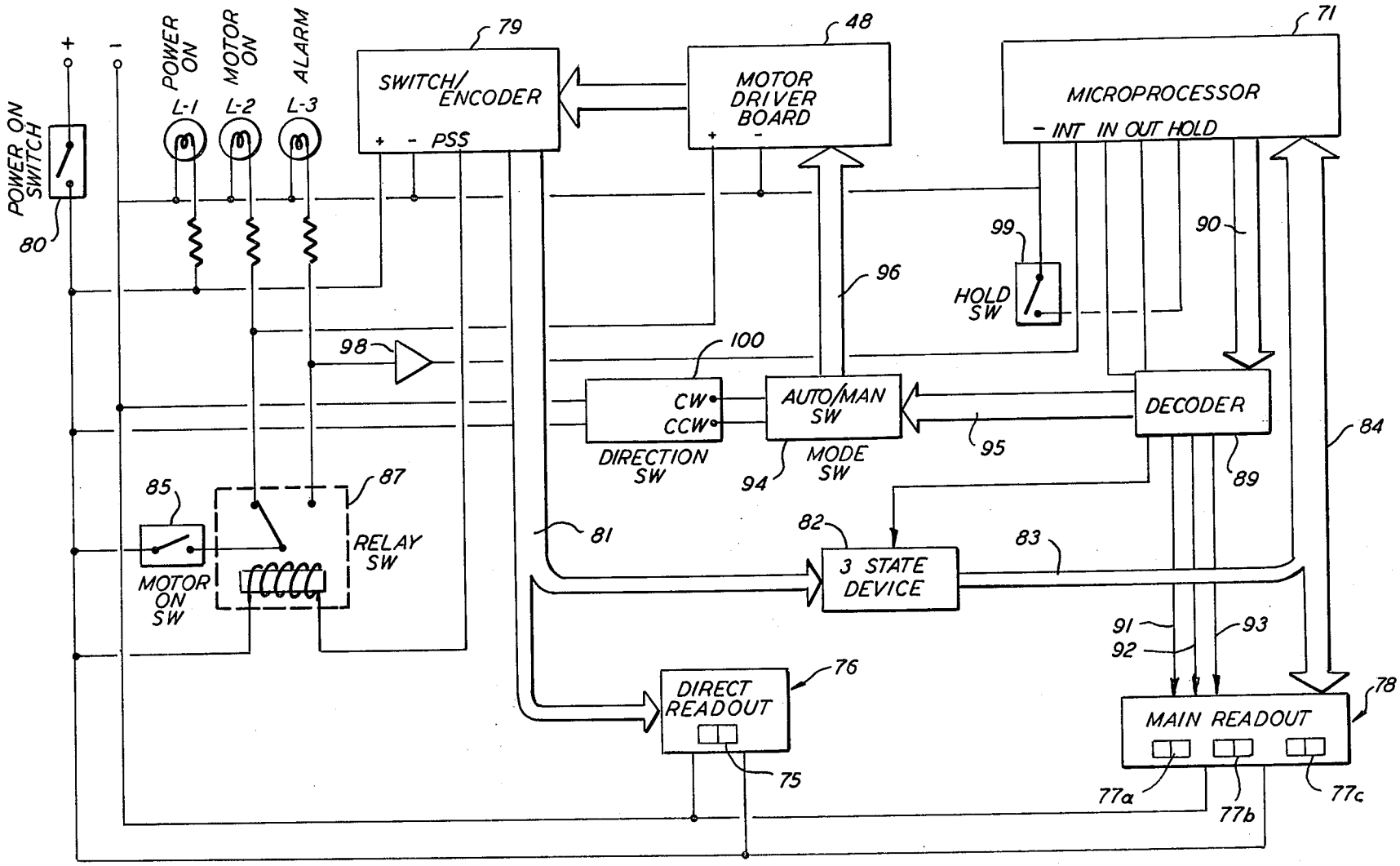
FIG. 5 is a wiring diagram illustrating the electrical connections between the various units.

Turning now to FIGS. 1 and 5, there is shown the control section of the present invention by which the dial of the lock is turned to set a predetermined sequence of combinations into the lock in an effort to determine the proper combination for opening the lock. In operation, the activity of the stepping motor is controlled by a general purpose microprocessor 71 acting through the motor driver board 48. The processor can be any one of many commercially available computers utilizing TTL (transistor to transistor logic) which is fully compatible with the motor driver board and the switch/encoder. The processor is arranged to receive information from the motor/coupler and switch/encoder unit 35 and to provide control signals to the motor driver board via interface board 73 (FIG. 1). Power to both the motor driver board and the interface board is provided by a 5 Volt- 5 amp. power supply 74. The computer is powered by a conventional 120 volt input. A pair of readout units 76 and 78 are also provided to give a visual indication of dial related activities. The first or direct readout unit 76 contains a single window 75 that records the exact dial position at any given time. The second or main readout unit 78 contains three windows *77a–77c* that record the three number combination that is being set into the lock. A keyboard input 72 is connected to the microprocessor which enables various programs to be placed in the processor or the ongoing program to be amended or updated.

As shown in FIG. 5, initially the power-on switch 80 is manually closed providing a path for current to reach the switch/encoder unit 79 and the two readout units 76 and 78. Lamp L-1 in the power unit is also illuminated at this time. The encoder board 55 (FIG. 4) is arranged to accept an input from the 100 contact switch 50 and convert each of the input signals to a separate seven bit binary number. As noted the contacts are aligned with the numbers upon the dial so that the encoder output corresponds to the number set into the dial. The binary output signal from the encoder is sent via a data buss 81 to both a three state device 82 and to the direct readout unit 76. The direct readout unit contains well known circuitry for converting the seven bit input data into a BCD (binary coded decimal) output. The BCD output, in turn, is passed through a driver (not shown) which is used to light a seven segment display in the window 75 that provides a visual presentation of the exact dial setting. At start-up the reading in the window can be checked against the actual dial setting and, if out of calibration, adjusted using the noted calibration mechanism.

Data sent to the three state device is passed onto the microprocessor via a data buss 83 and the main bidirectional data buss 84. The three state device acts as a control switch in the circuit which permits the encoder output data to be forwarded to the processor only when the main buss 84 is clear and the processor is in a condition to accept the data. The three state device is enabled by a signal from the processor address decoder 89.

After closing the power-on switch, a second manual switch in the power unit, the motor-on switch 85, is also closed. This illuminates a second lamp L-2 in the power unit indicating power is being applied to the motor driver board via relay switch 87 thereby placing the motor in a condition to be incremented in response to the program set into the microprocessor. The processor will typically be programmed to set a predetermined series of combinations into the lock and to instruct the dial to run through the above described opening sequence after each combination has been set into the lock.

The program contained in the processor first initializes three variables which, in practice, represent the three numbers making up the first combination in the series that is to be tried. The initial combination may be any three number set such as 00,00 and 00. The processor "reads" the input data from the previously initialized switch/encoder and instructs the motor, via the motor driver board, to turn the dial to the first number in the combination. Data to the motor driver board is initially applied by the main address buss 90 to a decoder unit 89 and then on to the motor driver board by busses 95 and 96 through a mode switch 94. The decoder also is connected to the main readout unit 78 by means of three latch enabling lines 91–93 that enable the unit to accept information concerning the combination being set into the lock via the main bidirectional data buss 84 and, as explained in reference to the direct readout unit, provide a visual presentation of the combination in the three windows *77a–77c*. As a result, the three number combination set into the dial is recorded in the main readout unit prior to the initiation of the above noted opening sequence.

After the combination has been set into the lock, the processor instructs the motor driver to increment the dial through an opening sequence. As noted above, this typically involves moving the dial to a zero reading to allow the key to engage the driver. The dial is further incremented to move the linkage back sufficiently to withdraw the bolt. In the event the combination is not the opening combination, the dial will move past the bolt withdrawal point and if the pressure sensitive switch 70 (FIG. 6) has not been activated, the processor will initiate the next combination in the sequence, such as 00,00 and 01. Although the present opening sequence is relatively simple, it should be recognized by one skilled in the art that more complex sequences might be carried out without departing from the teaching of the present invention.

It has been found that most locks are made so that the dog will fall into the tumbler notch when the dial is indexed close to but not exactly on the proper opening number. Accordingly, the program may be written so that the selected combinations that are set into the lock are two digits apart. This, of course, cuts the time involved in finding the opening combination by a factor of eight. Similarly, when one or more numbers of the combination are known, the program can be altered to set the known number or numbers into the dial during each combination test and simply changing the unknown number sequence thereby further shortening the opening time.

In the event an opening combination is reached, the bolt withdrawal link will lock the driver after the bolt is fully retracted and thus prevent the dial from turning any further in the direction of opening. As a consequence, the stepping motor which continues to drive against the resistance is torqued down against the resilient pad with sufficient force to close pressure sensitive switch 70 which applies a signal at the encoder output pressure sensitive switch noted as PSS in FIG. 5. This, in turn, causes the relay in relay switch 87 to be energized pulling the contact against the opposite terminal. The motor driver board is thus separated from the power supply as in lamp L-2. The alarm lamp L-3 is now illuminated signalling that the opening combination has been found. Current is also provided through amplifier 98 to the interrupt terminal of the microprocessor. With the processor inhibited, the last dialed combination displayed in the windows of the main readout is also frozen thus providing a visual display of the opening combination.

If, for some reason, it is desired to try a specific combination while a program is being run, hold switch 99 is manually cycled thus placing the processor in a hold condition. The mode switch 94 is then placed in a manual position connecting the motor driver board 48 to directional switch 100. The directional switch allows the dial to be twined in either direction to any desired number which will be displayed in the direct readout unit. After the specific combination has been tested, the switches are once again placed in the automatic position and the program is resumed.

While this invention has been described with reference to the embodiment herein disclosed, it should be evident that the present invention is broad enough to cover any modifications that come within the scope of the following claims.

I claim:

1. Apparatus for determining the opening combination of a lock of the type having a dial containing a number of equally spaced integers thereabout, a plurality of tumblers that are placed in alignment when an opening combination is set into the lock, a driver operatively connected to the tumblers that is able to move through a lock opening sequence when the tumblers are aligned to withdraw the lock bolt, the apparatus including a rotor means for engaging both the dial and the driver of the lock for turning the dial in either direction so that a combination can be set into the lock and for moving the driver through an opening sequence, programmable means for controlling the rotor means for moving the dial through an ordered sequence of combinations and to move the driver through the opening sequence after each combination is set into the lock, sensing means connected to the rotor means for detecting the instantaneous position of the dial and sending a coded signal to the programmable means indicative of the dial position, readout means connected to the programmable means for sequentially recording each combination that is set into the lock, and inhibiting means for holding the combination recorded in the readout means when the lock bolt is withdrawn by said driver.

2. The apparatus of claim 1 wherein said rotor means includes a stepping motor connected to said dial by a shaft means and a motor driver means operatively connected to the programmable means for stepping said motor.

3. The apparatus of claim 2 wherein said sensing means includes a switch means having a movable contact affixed to said rotor shaft for movement therewith and a series of stationary contacts equally spaced about said shaft that are equal in number to the number of integers on said dial, and an encoder means connected to each of the stationary contacts for applying a different output signal to the programmable means when each of the stationary contacts are closed by said movable contact to provide an output signal that is indicative of the number at which the dial is positioned.

4. The apparatus of claim 3 wherein said output of said encoder output signal is also applied to a second direct readout means for providing a visual presentation of the number at which the dial is positioned at any given time.

5. The apparatus of claim 3 that further includes calibration means attached to the switch means for aligning the stationary contacts with the integers on said dial.

6. The apparatus of claim 1 that further includes a hold circuit means for interrupting the programmable means and a manually operated directional switch connected to the motor driver means for manually incrementing the dial whereby preselected combinations can be set into the dial.

7. The apparatus of claim 2 wherein said inhibiting means includes a pressure sensitive switch connected to the stepping motor which is arranged to close when the motor turns the rotor means to a bolt withdrawal position.

8. The apparatus of claim 7 that further includes an alarm means connected to said pressure sensitive switch for providing an alarm signal when said switch is closed.

9. The apparatus of claim 2 wherein said shaft means includes a plurality of pivotably mounted arms mounted in the distal end of the shaft and a biasing means acting upon the arms for urging the arms into holding contact against the dial.

10. The method of determining the opening combination of a lock having a dial assembly and a driver for withdrawing the lock bolt that includes the steps of connecting a stepping motor to the dial of a combination lock whereby the dial can be incremented in either direction to set predetermined combinations into the lock, controlling the incrementing of the motor to set an ordered sequence of combinations into the lock, moving the driver through a lock opening sequence after each combination is set into the lock to determine when an opening combination has been reached, and automatically recording the opening combination when the lock is opened.

11. The method of claim 10 that includes the further step of preprogramming the ordered sequence of combinations that are set into the lock.

12. The method of claim 10 that includes the further step of inhibiting the stepping motor when the lock is opened.

13. The method of claim 10 that includes the further step of providing an alarm signal when the lock is opened.

* * * * *